US007971765B2

(12) United States Patent
Engle

(10) Patent No.: US 7,971,765 B2
(45) Date of Patent: Jul. 5, 2011

(54) METHODS AND APPARATUS FOR SPLITTING TABLETS

(75) Inventor: David A. Engle, Fogelsville, PA (US)

(73) Assignee: Fisher Clinical Services, Inc., Allentown, PA (US)

( * ) Notice: Subject to any disclaimer, the term of this patent is extended or adjusted under 35 U.S.C. 154(b) by 145 days.

(21) Appl. No.: 11/681,598

(22) Filed: Mar. 2, 2007

(65) Prior Publication Data

US 2008/0210731 A1 Sep. 4, 2008

(51) Int. Cl.

| | |
|---|---|
| ***B26F 3/00*** | (2006.01) |
| ***B26F 3/02*** | (2006.01) |
| ***B65H 35/10*** | (2006.01) |
| ***B26D 7/06*** | (2006.01) |
| ***B26D 1/00*** | (2006.01) |
| ***B65B 1/00*** | (2006.01) |
| ***B65B 3/00*** | (2006.01) |

(52) U.S. Cl. ..... 225/1; 225/103; 83/25; 83/196; 53/266.1

(58) Field of Classification Search ..... 225/1, 103; 30/124; 83/23, 157, 196, 198–200, 932; 53/266.1

See application file for complete search history.

(56) References Cited

U.S. PATENT DOCUMENTS

| | | | | |
|---|---|---|---|---|
| 4,697,344 | A * | 10/1987 | Leopoldi | 30/124 |
| D310,731 | S | 9/1990 | Lieptz | |
| 5,038,475 | A * | 8/1991 | Wolff | 30/124 |
| 5,081,822 | A * | 1/1992 | Boyd et al. | 53/468 |
| 5,118,021 | A | 6/1992 | Fiocchi | |
| 5,944,243 | A | 8/1999 | Weinstein | |
| 6,244,146 | B1 * | 6/2001 | Arthur et al. | 83/23 |
| 6,474,525 | B1 | 11/2002 | Reitano | |
| 6,527,155 | B2 * | 3/2003 | Buckley et al. | 225/1 |
| 6,557,945 | B1 * | 5/2003 | Eric | 30/124 |
| 6,968,987 | B1 | 11/2005 | Reitano | |
| 7,000,815 | B1 | 2/2006 | Tipton et al. | |
| 2003/0019900 | A1 | 1/2003 | Dienst | |
| 2005/0067452 | A1 | 3/2005 | Darst | |
| 2005/0242304 | A1 * | 11/2005 | Armbuster et al. | 250/559.16 |
| 2006/0138190 | A1 | 6/2006 | Williams | |

* cited by examiner

*Primary Examiner* — Ghassem Alie
*Assistant Examiner* — Bharat C Patel
(74) *Attorney, Agent, or Firm* — Workman Nydegger

(57) ABSTRACT

A method for splitting tablets includes positioning a plurality of tablets onto a supporting structure. Each of the plurality of tablets are then substantially simultaneously split into at least two parts. Finally, if desired, the at least two parts of each tablet are dispensed into a compartment of a corresponding one of a plurality of first capsule portions.

12 Claims, 12 Drawing Sheets

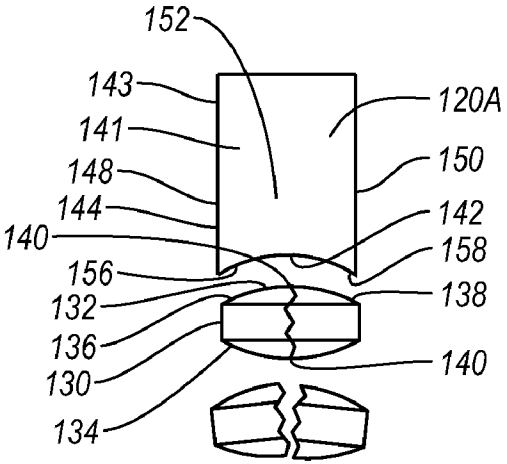
Fig. 5A
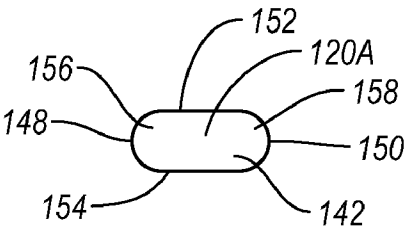
Fig. 5B
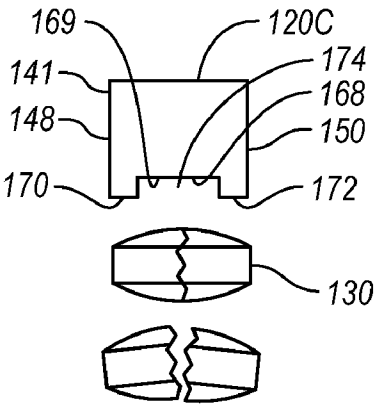
Fig. 6A
Fig. 6B
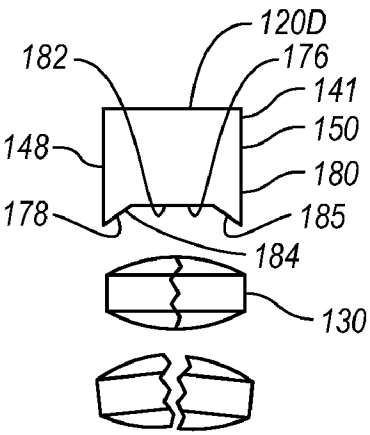
Fig. 6C

METHODS AND APPARATUS FOR SPLITTING TABLETS

CROSS-REFERENCE TO RELATED APPLICATIONS

Not applicable.

BACKGROUND OF THE INVENTION

1. The Field of the Invention

The present invention relates to methods and apparatus for splitting tablets and/or positioning a split tablet within a capsule.

2. The Relevant Technology

New drugs typically need to pass through stringently controlled drug trials before they can be marketed. During the drug trials, the drug is administered to a defined group of patients and the effects of the drug are monitored. As part of the testing procedure, a select portion of the patients are administered a placebo so that a comparison can be made between those who actually receive the drug and those who simply believe they are receiving the drug.

Another method of testing a drug is through comparison studies. In this process a drug is compared to a competitor's drug or to a prior version of the drug. Comparison studies are also performed by administering the two drugs to different groups of patients and then monitoring the effects of the drugs.

To effectively administer a placebo or drug comparison, it is necessary that the dosage forms for the drugs and the placebo look identical so that the patients are unable to determine which drug they are receiving or whether they are receiving a drug or a placebo.

Dosage forms for drugs are typically manufactured in the form of tablets. Depending on the properties of a drug, however, the appearance, texture, and/or taste of the drug can make it difficult to reproduce a placebo tablet having the same properties as a drug tablet. Likewise, it can be difficult to make two tablets having the same above properties where the tablets are comprised of different drugs. Furthermore, it can be expensive to try and reproduce placebo tablets or other drug tablets so as to have the same form and properties as a multitude of different drug tablets.

In one approach to solve the above problems, tablets of a first drug are placed within opaque capsules which hide the drug. Placebos or tablets of a second drug are then placed within identical capsules so that the patients are unable to determine which drug the capsules contain or whether the capsules contain a placebo.

One difficulty with this approach, however, is that tablets are sometimes formed having a diameter that is larger than the opening for conventional capsules. To facilitate position of tablets within capsules, manual splitters have been designed where a user manually splits each tablet one at a time. The user then picks up the split tablet portions and positions them within a capsule. This process is slow, highly labor intensive, and is not always effective in ensuring the complete tablet is positioned within a capsule.

Accordingly, what is needed are efficient ways for rapidly splitting tablets and positioning the tablets within corresponding capsules.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

FIG. 5A is an elevated side view of a splitter with a tablet;

FIG. 5B is a bottom plan view of the splitter shown in FIG. 5A;

FIGS. 6A-6C are alternative embodiments of a splitter for use with the tablet shown in FIG. 5A;

DETAILED DESCRIPTION OF THE PREFERRED EMBODIMENTS

Figure 1:
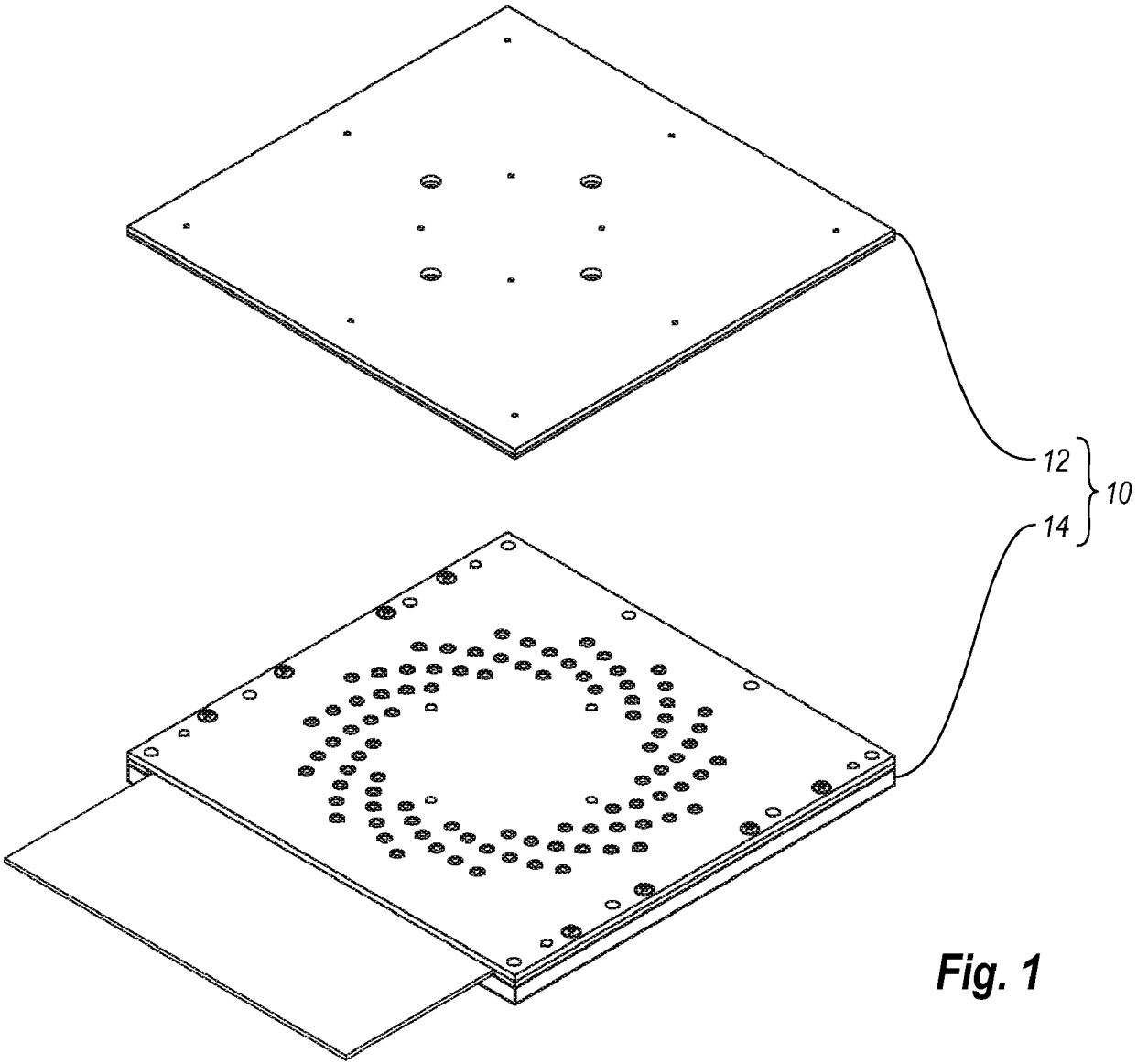
FIG. 1 is a perspective view of a tablet splitter assembly.

Depicted in FIG. 1 is one embodiment of an inventive tablet splitter system 10 incorporating features of the present invention. In general, tablet splitter system 10 is configured to simultaneously split a plurality of tablets each into two or more parts and then facilitate dispensing the parts for each tablet into a corresponding capsule. The capsules can then be dispensed to patients such as in drug trials or in other conventional uses.

Figure 2:
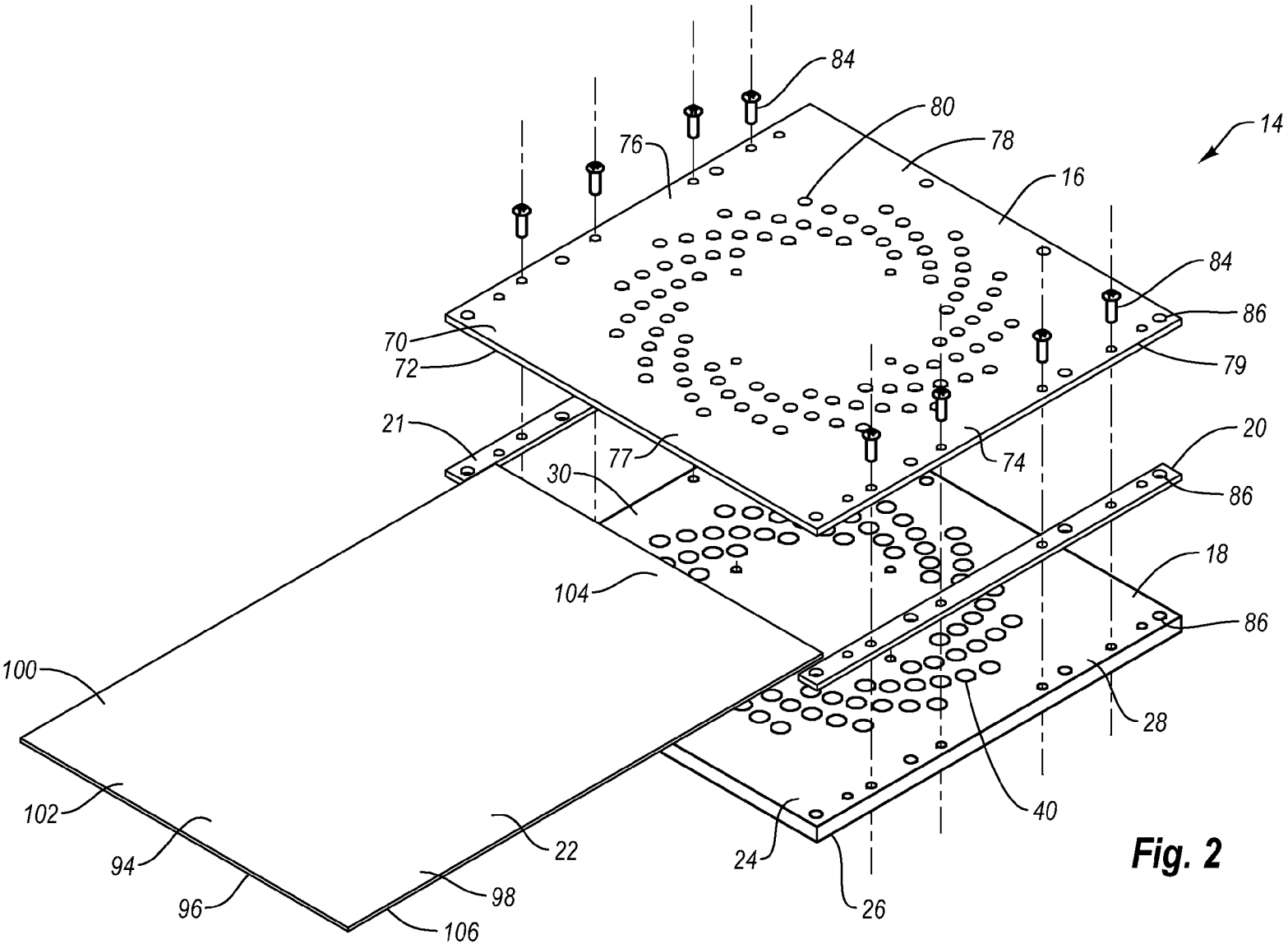
FIG. 2 is an exploded perspective view of the base assembly of the tablet splitter assembly shown in FIG. 1.

Tablet splitter system 10 comprises a splitter assembly 12 and a base assembly 14. As depicted in FIG. 2, base assembly 14 generally comprises a retention plate 16, a guide plate 18, and a pair of spacers 20 and 21 that are disposed between retention plate 16 and guide plate 18. Base assembly 14 further includes a stop plate 22 that is moveable disposed between retention plate 16 and guide plate 18.

Figure 3:
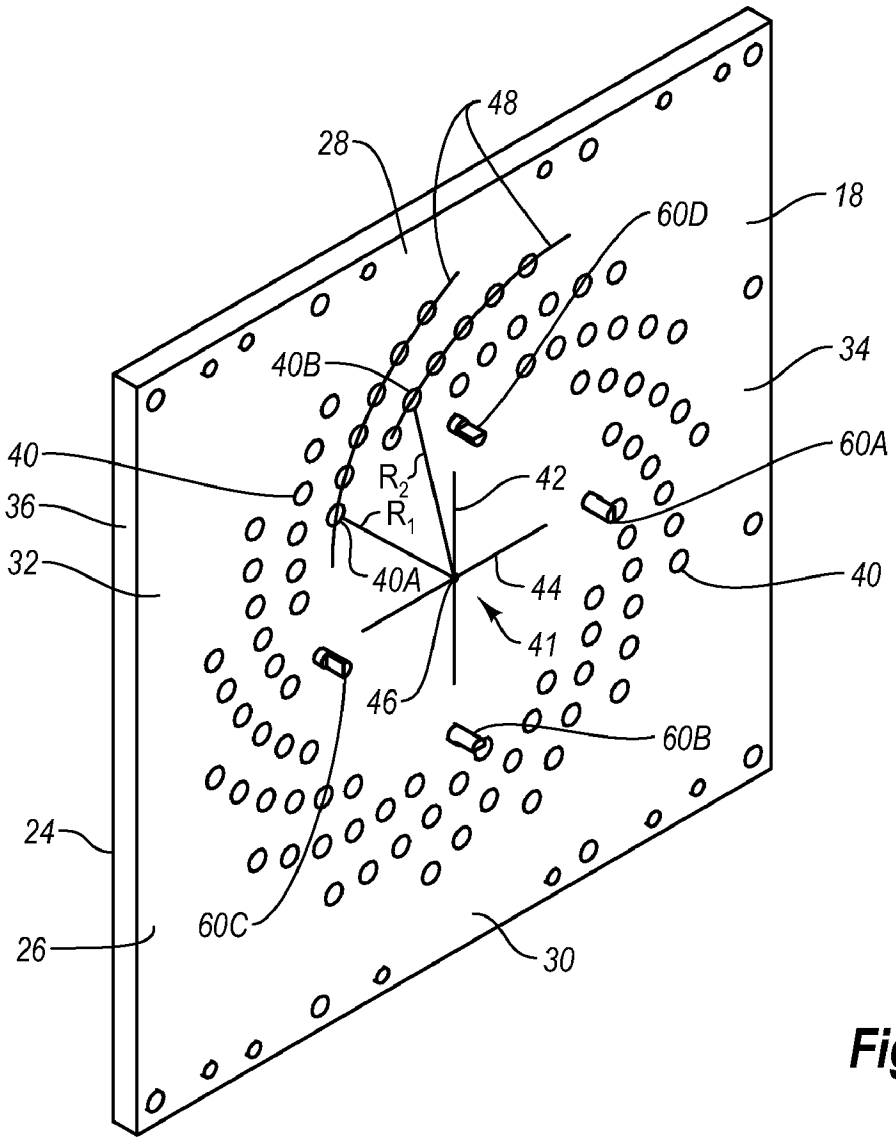
FIG. 3 is a bottom perspective view of a guide plate shown in FIG. 2.

Turning to FIG. 3, guide plate 18 has a top surface 24 and an opposing bottom surface 26 that each extend between opposing side edges 28 and 30 and between a front edge 32 and an opposing back edge 34. In the embodiment depicted, top surface 24 and bottom surface 26 are substantially planer with guide plate 18 having a substantially square configuration. In alternative embodiments, opposing surfaces 24 and 26 need not be planer or complimentary and guide plate 18 need not be square. For example, guide plate 18 can be rectangular, circular, triangular, or any other desired polygonal or irregular configuration. Guide plate 18 has a perimeter edge 36 that extends between top surface 24 and bottom surface 26. Perimeter edge 36 typically has a thickness in a range between about 0.5 cm to about 3 cm with about 0.5 cm to about 1.5 cm being more common. As will be discussed below in greater detail, the thickness of guide plate 18 can vary with the size of the tablet to be split. Thus, other thicknesses can also be used.

Extending through guide plate 18 from top surface 24 to bottom surface 26 are a plurality of holes 40. As will be discussed below in greater detail and as better illustrated in FIG. 15, each hole 40 is bounded by an interior surface 54 having a substantially frustoconical configuration. That is, hole 40 gradually tapers from an enlarged opening 56 on top surface 24 to a constricted opening 58 on bottom surface 26. Each hole 40 is depicted having a substantially circular transverse cross sectional configuration. In alternative embodiments it is appreciated that holes 40 can have an elliptical, polygonal, elongated, or irregular configuration. In part, the configuration of hole 40 depends on the configuration of the tablet. However, holes 40 need not have the same configuration as the tablets but may be so configured.

Returning to FIG. 3, holes 40 are disposed in a general spiral configuration on guide plate 18. More specifically, guide plate 18 is disposed in a plane having a coordinate axis 41 defined by a first linear axis 42 and an orthogonally intersecting second linear axis 44. In the embodiment depicted, first linear axis 42 extends between side edges 28 and 30. Second linear axis 44 extends between front edge 32 and opposing back edge 34. Axes 42 and 44 intersect at a vertex 46 that is centrally disposed on guide plate 18 but can be otherwise positioned.

Each hole 40 is centrally disposed along one of a plurality of imaginary curved lines 48 that are radially spaced apart about coordinate axis 41. Each curved line 48 has substantially the same curvature that can have either a fixed or variable radius. Holes 40 are disposed along curve lines 48 such that the corresponding hole 40 for each curved line 48 is disposed at substantially the same radial distance from vertex 46. For example, each first hole 40A for each line 48 is disposed at the same radial distance $R_1$ from vertex 46 while each second hole 40B for each line 48 is disposed at the same radial distance $R_2$ from vertex 46. Imaginary curved lines 48 are configured so that each subsequent hole 40 on a given curved line 48 is disposed at a location that is progressively farther out from vertex 46 and each subsequent hole 40 is at a different angle relative to coordinate axis 41. The plurality of holes 40 and plurality of curved lines 48 are typically positioned so as to be symmetrical about coordinate axis 41. Furthermore, curved lines 48 are equally radially spaced about coordinate axis 41 so that the distance between the first holes 40A of all adjacent lines 48 are the same.

It is appreciated that the above placement for holes 40 is only one example. In alternative embodiments, it is appreciated that the plurality of holes 40 can be disposed in a variety of different patterns. For example, holes 40 can be disposed along linear lines, in grid patterns, or in randomly dispersed patterns. However, the above discussed patter has some unique benefits as will be discussed below.

Outwardly projecting from bottom surface 26 of guide plate 18 are plurality of pins 60. In the embodiment depicted, four pins 60A-D are symmetrically spaced out from vertex 46. In alternative embodiments, one, two, three, or five or more pins 60 can be used. As will be discussed below in greater detail, pins 60 are used to removeably secure guide plate 18 to a capsule ring.

Returning to FIG. 2, retention plate 16 is shown having a size and configuration similar to guide plate 18. Specifically, retention plate 16 has a top surface 70 and opposing bottom surface 72 that each extend between opposing side edges 74 and 76 and between a front edge 77 and an opposing back edge 78. In the embodiment depicted, top surface 70 and bottom surface 72 are substantially planer with retention plate 16 having a substantially square configuration. In alternative embodiments, opposing surfaces 70 and 72 need not be planer or complimentary and retention plate 16 need not be square. For example, retention plate 16 can be rectangular, circular, triangular, or any other desired polygonal or irregular configuration. Retention plate 16 can have a configuration that is the same as or different than guide plate 18. Retention plate 16 has a perimeter edge 79 that extends between top surface 70 and bottom surface 72. Perimeter edge 79 typically has a thickness in a range between about 0.5 cm to about 3 cm with about 0.5 cm to about 1.5 cm being more common. Other thicknesses can also be used.

Figure 14:
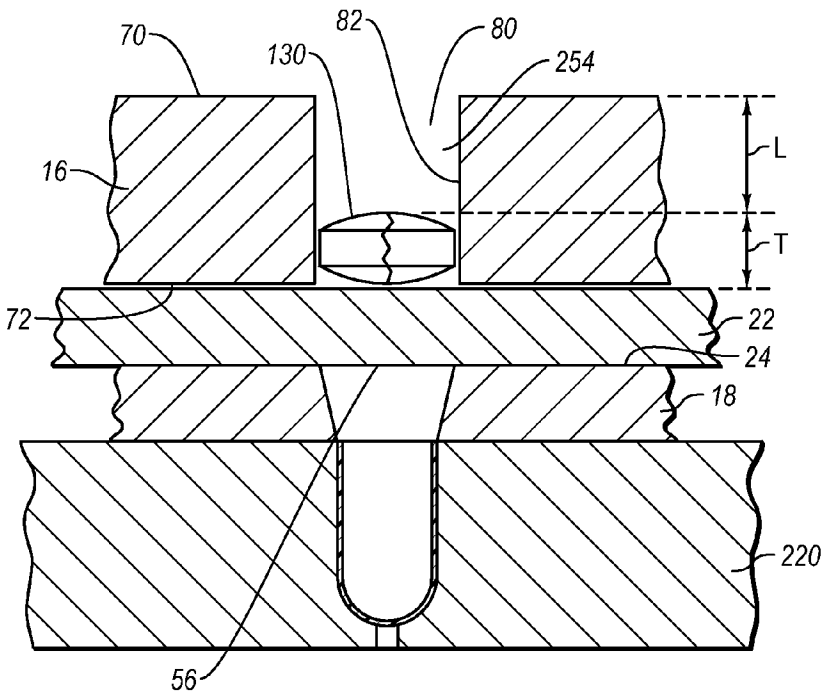
FIG. 14 is a cross sectional side view of the tablet of FIG. 13 being split with the splitter removed.

A plurality of holes 80 are formed on retention plate 16 and extend between top surface 70 and opposing bottom surface 72. Holes 80 have substantially the same layout as holes 40 on guide plate 18. As such, the above discussion with regard to holes 40 on guide plate 18 and the alternatives discussed relative thereto is also applicable to holes 80 on retention plate 16. Holes 80 are formed on retention plate 16 so that they can be vertically or axially aligned with corresponding holes 40 on guide plate 18. However, in contrast to holes 40 which taper along the length thereof, holes 80, as depicted in FIG. 14, are typically bounded by an interior surface 82 having a substantially constant configuration along the length thereof. Although not required, holes 80 typically have the same size and configuration as opening 56 on top surface 24 of guide plate 18.

Returning to FIG. 2, spacers 20 and 21 comprise flat elongated members that are sandwich between retention plate 16 and guide plate 18. Specifically, spacer 20 is disposed between side edges 74 and 28 whereas spacer 21 is disposed between side edges 76 and 30. Retention plate 16, guide plate 18, and spacers 20 and 21 can be secured together using a variety of conventional techniques. For example, in the embodiment depicted, a plurality of fasteners 84 extend through retention plate 16, spacers 20, 21, and into or through guide plate 18 so as to secure the structures together. Fasteners 84 can comprise screws, bolts, rivets, or the like.

In the embodiment shown, a plurality of openings 86 extend through retention plate 16 along side edges 74 and 76, through spacers 20, 21, and through guide plate 18 along side edges 28 and 30. Openings 86 assist fasteners 84 in passing through and/or engaging with the various structures. In alternative embodiments, adhesive, welding, clamps, or other conventional fastening techniques can be used to secure retention plate 16, guide plate 18, and spacers 20, 21 together. In still further embodiments, it is appreciated that spacers 20 and 21 can be integrally formed as part of one of retention plate 16 and/or guide plate 18. Retention plate 16, guide plate 18, and spacers 20 and 21 can also be formed as an integral, monolithic structure formed as a single part. Furthermore, spacers 20 and 21 need not extend along the full length of the side edges but can be positioned at opposing ends thereof and/or staggered along the side edges.

As a result of sandwiching spacers 20 and 21 between retention plate 16 and guide plate 18, a gap 90 (FIG. 15) is formed between retention plate 16 and guide plate 18. Gap 90 typically has a thickness in a range between about 0.3 cm to about 1.5 cm with about 0.5 cm to about 1 cm being more common. Other dimensions can also be used. It is again noted that each of holes 80 on retention plate 16 is vertically or axially aligned with a corresponding hole 40 on guide plate 18.

As depicted in FIG. 2, stop plate 22 is shown comprising a solid plate having a top surface 94 and an opposing bottom surface 96 that extend between opposing side edges 98 and 100 and between a front edge 102 and an opposing back edge 104. In the embodiment depicted, top surface 94 and bottom surface 96 are substantially planer with stop plate 22 having a substantially square configuration. In alternative embodiments, opposing surfaces 94 and 96 need not be planer or complimentary and stop plate 22 need not be square. For example, stop plate 22 can be rectangular, circular, triangular, or any other desired polygonal or irregular configuration. Stop plate 22 can also have a configuration that is the same as or different than retention plate 16 and/or guide plate 18. Stop plate 22 has a perimeter edge 106 extending between top surface 94 and bottom surface 96 having a thickness that is less than the thickness of gap 90. In one embodiment, perimeter edge 106 typically has a thickness that is less than the thickness of gap 90 by about 0.05 cm to about 0.2 cm. Other thicknesses can also be used. As a result of stop plate 22 having a thickness less than that of gap 90, stop plate 22 can freely slide within gap 90 between retention plate 16 and guide plate 18.

During operation, stop plate 22 is selectively moved between a first position wherein stop plate is disposed between retention plate 16 and guide plate 18 so as to block passage between holes 80 on retention plate 16 and holes 40 on guide plate 18. Stop plate 22 can also be outwardly slide into a second position wherein stop plate 22 is at least partially removed from between retention plate 16 and guide plate 18 so that open communication is provided between aligned holes 80 and 40.

Figure 4:
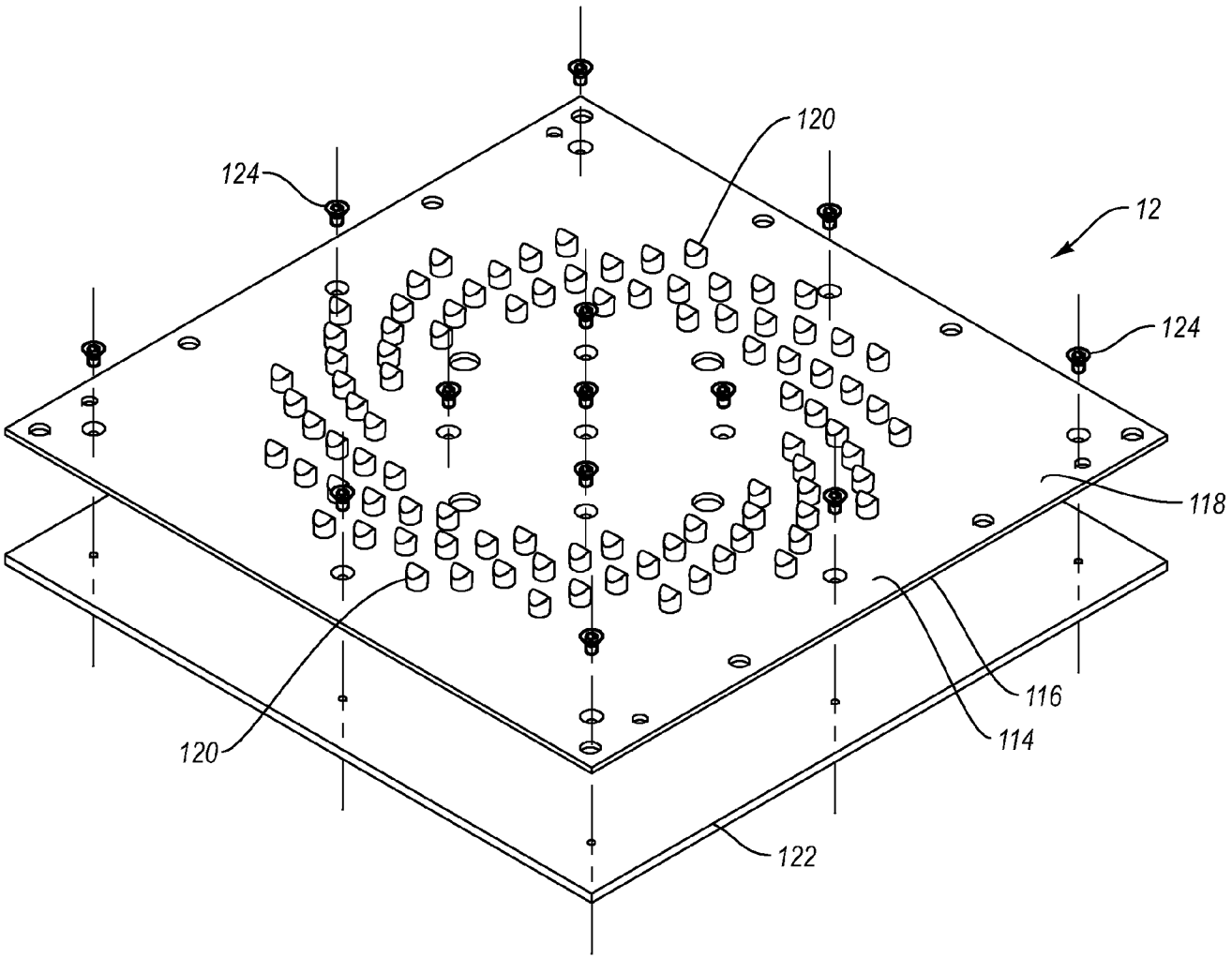
FIG. 4 is an exploded bottom perspective view of a splitter assembly shown in FIG. 1.

Turning to FIG. 4, splitter assembly 12 comprises a splitter plate 114 having a top surface 116 and an opposing bottom surface 118. Outwardly projecting from bottom surface 118 are a plurality of spaced apart splitters 120. Although not required, splitter plate 114 can have substantially the same configuration as retention plate 16 and guide plate 18. Alternatively, splitter plate 114 can have any of the alternative configurations as previously discussed with regard to plates 16 and 18 or can have a configuration different from plates 16 and 18. Splitters 120 are orientated in substantially the same pattern as holes 80 on retention plate 16. Furthermore, each of splitters 120 is configured so that it can be received within a corresponding hole 80 on retention plate 16. Splitters 120 can be integrally formed with splitter plate 114 so as to form a single monolithic structure or can be separately connected to splitter plate 114 such as by welding, adhesive or fasteners. If desired, a reinforcing plate 122 can be mounted on top surface 116 of splitter 114. Reinforcing plate 122 can be connected to splitter plate 114 using fasteners 124 or using other conventional techniques such as adhesive, welding, clamps, or the like.

Splitters 120 are configured to split a tablet into two or more parts so that each tablet can be fit within a capsule. As discussed in the background section, fitting a tablet formed from or incorporating a drug into a capsule is one desirable method for testing the drug during drug trials. In one embodiment, it is desirable that splitters 120 split the tablet in two substantially equal halves. By splitting all of the tablets into two equal parts, practitioners can ensure that all tablets are broken down internally at substantially the same rate when ingested by a patient. Regulating the break down of ingested tablets can be important when performing drug trials using the tablets. It is also appreciated that the tablets can be broken down into three or more equal parts. In other applications, the break down rate of ingested tablets can be irrelevant and thus the tablets can be randomly split or crushed into any number of parts.

It is appreciated that splitters 120 can have a variety of different configurations to achieve the desired objective. The configuration of splitters 120 in part depends upon the configuration of the tablets being split. By way of example and not by limitation, depicted in FIG. 5A is a splitter 120 for use in splitting a tablet 130. Tablet 130 is shown having a circular top surface 132 and an opposing circular bottom surface 134 each having a domed convex curvature that terminates at a central apex 140. Top surface 132 of tablet 130 is defined as having opposing sides 136 and 138. As a result of bottom surface 134 having a convex curvature with a centrally disposed apex 140, applying vertical downward loads on opposing sides 136 and 138 of top surface 132 produces a stress point at apex 140 on top surface 132. Accordingly, by providing a sufficient load to opposing sides 136 and 138, tablet 130 will fail or split into two generally equal parts along a plane that generally extends centrally through tablet 130 by passing through apex 140 on top surface 132 and through apex 140 on bottom surface 134 as illustrated in FIG. 5A.

To achieve the above desired splitting of tablets 130, splitters 120 are configured to apply equal loads to sides 136 and 138 when biased against tablet 130. As depicted in FIGS. 5A and 5B, splitter 120A comprises an elongated stem 141 having a proximal end 143 and an opposing distal end 144. Distal end 144 terminates at a distal end face 142. Although not required, proximal end 143 of stem 141 typically has a substantially circular transverse configuration where it couples with splitter plate 114. However, distal end 144 is tapered, as depicted in the bottom plan view of FIG. 5B, so as to have a generally rectangular configuration.

Figure 13:
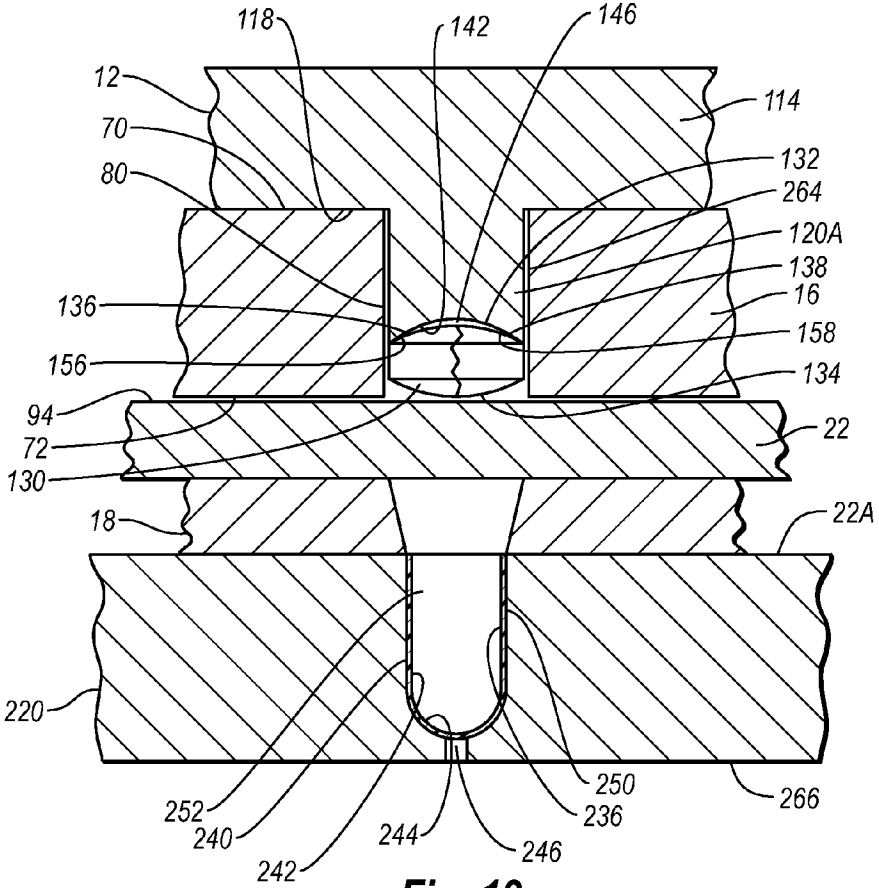
FIG. 13 is a cross sectional side view of a tablet being compressed between a splitter and a stop plate.

Specifically, distal end 144 of stem 141 has opposing end walls 148 and 150 each having a radius of curvature substantially equal to the radius of curvature of holes 80 in retention plate 16. A substantially flat front face 152 and an opposing substantially flat back face 154 extend between end walls 148 and 150. Distal end face 142 has a substantially convex curvature that extends between a first end 156 located toward end wall 148 and an opposing second end 158 located toward end wall 150. The curvature of distal end face 142 is configured such that when splitter 120A is vertically aligned with and pressed down against top surface 132 of tablet 130, as depicted in FIG. 13, ends 156 and 158 of distal end face 142 bias against sides 136 and 138 of top surface 132 of tablet 130, respectively, but a slight gap 146 is formed between the central apex of top surface 132 of tablet 130 and the central apex of distal end face 142 of splitter 120A. Accordingly, as splitter 120A is further pressed down against tablet 130, splitter 120A produces equal loads against sides 136 and 138 of tablet 130 causing tablet 130 to split into substantially two equal halves as discussed above.

It is appreciated that distal end face 142 of splitter 120A can have a variety of different configurations and still achieve the desired objective of applying equal loads on opposing sides 136 and 138 of tablet 130. For example, distal end face 142 could be substantially circular as long as distal end face 142 was sufficiently taped so that the greatest load applied by splitter 120A was at opposing sides 136 and 138 of tablet 130.

Depicted in FIGS. 6A-8B are other examples of splitters comprising stem 141. It is appreciated that like elements between the splitters are identified by like reference characters. FIG. 6A depicts a splitter 120B having a substantially rectangular transverse cross section at the distal end thereof as previously discussed with regard to FIG. 5B. Splitter 120B has a distal end face 160 which, in contrast to having a smooth continuous concave curvature as previously discussed with regard to FIG. 5A, comprises a substantially planner first face 162 that upwardly and inwardly projects from end wall 148 to a central apex 163 and a substantially planner second face 164 that upwardly and inwardly projects from end wall 150 to central apex 163. Again, during use, distal end face 160 is configured so that faces 162 and 164 bias against sides 136 and 138 of tablet 130 so as to split tablet 130 into two equal parts.

Depicted in FIG. 6B, a splitter 120C is shown having a distal end face 168. In this embodiment, distal end face 168 comprises a substantially planar end face 169 that extends normal to the central longitudinal axis of stem 141. A first arm 170 downwardly projects from end face 169 adjacent to end wall 148 and a second arm 172 downwardly projects from end face 169 adjacent to end wall 150. Each arm 172 and 174 terminates at a planer end face that also extends normal to the central longitudinal axis of stem 141. A recess 174 is centrally formed between arms 170 and 172. Again, arms 170 and 172 function to bias against opposing sides of tablet 130 for splitting tablet 130.

Depicted in FIG. 6C, a splitter 120D is shown having a distal end face 176. Distal end face 176 comprises a substantially planar end face 182 that extends normal to the central longitudinal axis of stem 141. A first arm 178 downwardly projects from end face 182 adjacent to end wall 148 and a second arm 180 downwardly projects from end face 182 adjacent to end wall 150. Each arm 178 and 180 has a substantially triangular transverse cross sectional configuration. Arm 178 has an outwardly sloping inside face 184 while arm 180 has an outwardly sloping inside face 185. Faces 184 and 185 function to bias against opposing sides of tablet 130 for splitting tablet 130.

Figure 7B:
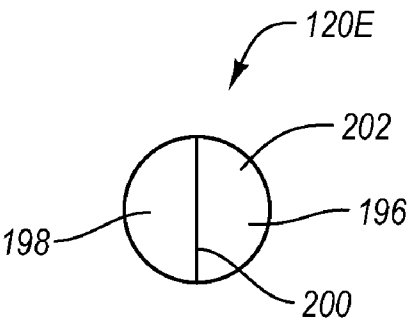
FIG. 7B is a bottom plan view of the splitter shown in FIG. 7A.
Figure 7A:
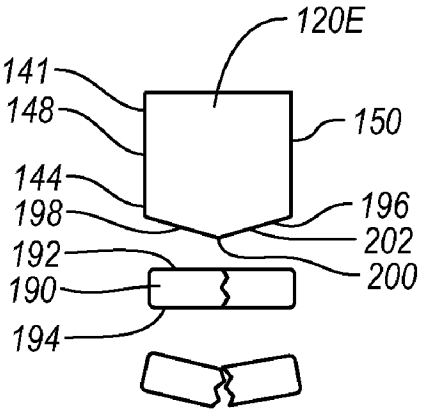
FIG. 7A is an elevated side view of a splitter for use with a tablet having flat sides.

Depicted in FIG. 7A, a tablet 190 is shown having a circular configuration. However, in contrast to having a top surface and a bottom surface that are concaved, tablet 190 has a top surface 192 and an opposing bottom surface 194 that are substantially planer. To facilitate splitting tablet 190 into two equal parts, a splitter 120E is provided having a distal end 144 with a substantially circular transverse cross sectional configuration as depicted in FIG. 7B. Splitter 120E has a distal end face 196 have a V-shaped configuration. Specifically, end face 196 comprising a planer, semi-circular first face 198 that inwardly and downwardly slopes from end wall 148 to a central ridge 200 and a planer, semi-circular second face 202 that inwardly and downwardly slopes from end wall 150 to central ridge 200. During use, ridge 200 of splitter 120E is centrally biased against top surface 192 of tablet 190 so as to fracture tablet 190 into two equal parts.

Figure 8B:
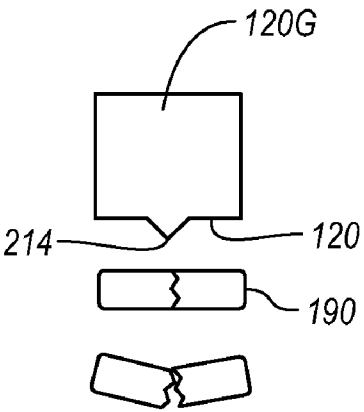
FIGS. 8A and 8B are elevated side views of alternative embodiments of a splitter for use with tablet shown in FIG. 7A.
Figure 8A:
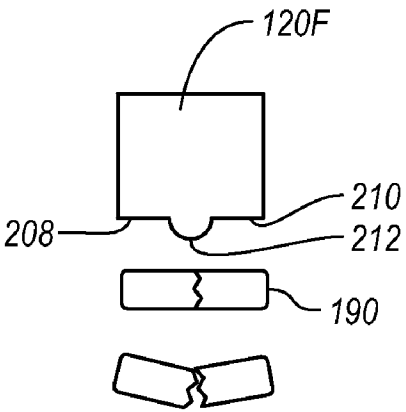

Depicted in FIG. 8A is an alternative embodiment of a splitter 120F configured for splitting tablet 190. Splitter 120F has a terminal end face 208 that comprises a substantially flat end face 210. An elongated rounded ridge 212 downwardly projects from end face 210 and transversely extends across end face 210. Ridge 212 of splitter 120F centrally biases against top surface 192 of tablet 190 so as to fracture tablet 190 into two equal parts.

Depicted in FIG. 8B, a splitter 120G is disclosed having substantially the same configuration as splitter 120F. The only distinction is that rounded ridge 212 has been replaced with an elongated sharpened ridge 214 having a substantially triangular transverse cross sectional configuration.

It is appreciated that the foregoing are only illustrative examples of different splitters that can be used to split tablets into two equal parts. Based on the foregoing, those skilled in the art can appreciate that there are a variety of alternative configurations can likewise be used to achieve the same objective. Furthermore, it is appreciated that the configuration of the splitters can change when used with still other tablet configurations. For example, it is appreciated that holes 40 and 80 in base assembly 14 can be modified to complementary fit tablets having an elongated, square, triangular, or other polygonal or irregular tablet configurations. Likewise, splitters can be adapted for splitting such alternative shaped tablets.

Figure 9:
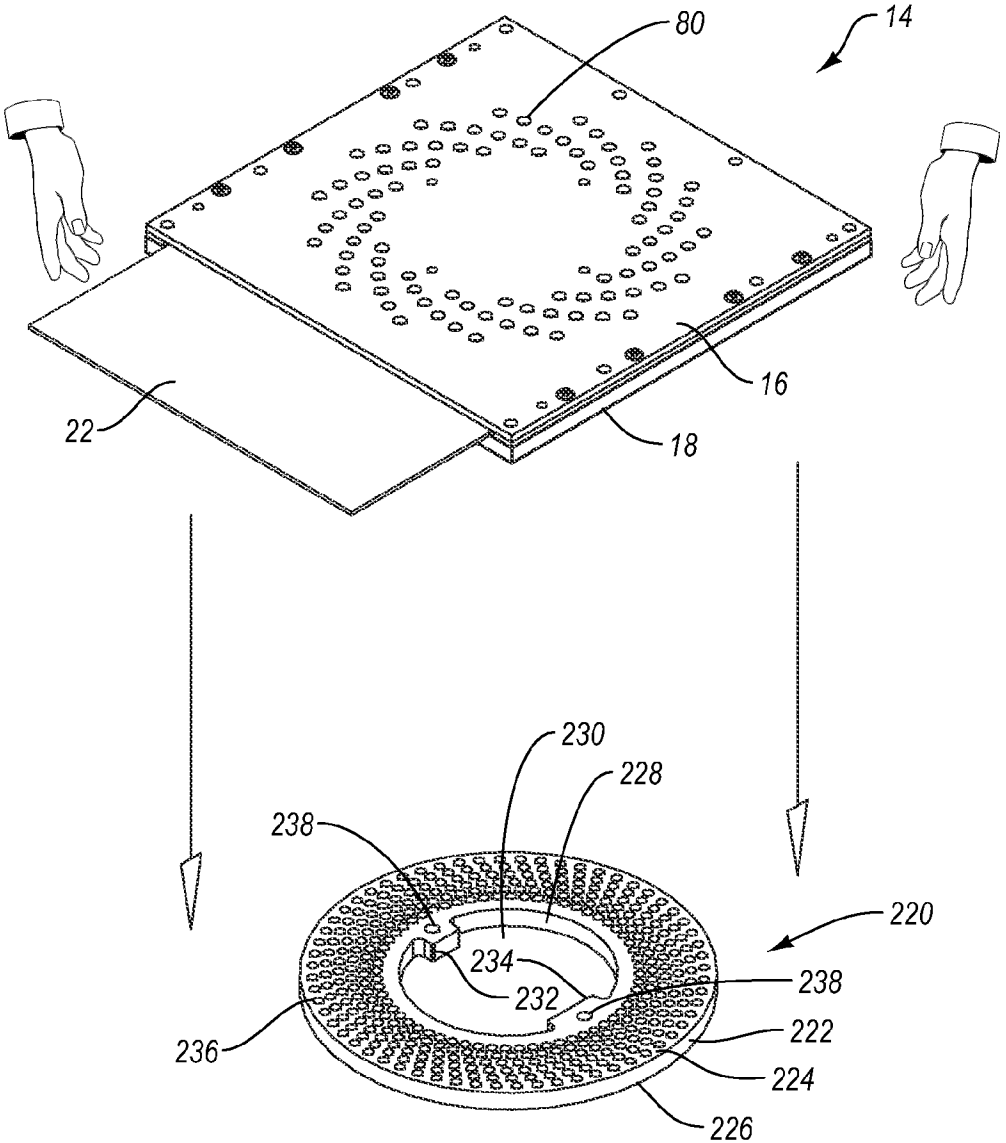
FIG. 9 is a perspective view of the base assembly shown in FIG. 1 being mounted on a capsule ring.

Depicted in FIG. 9 is a standard capsule ring 220 that can be purchased from Capsugel out of Greenwood, S.C. Capsule ring comprises a circular body 222 having a top surface 224 and an opposing bottom surface 226. A plurality of capsule ports 236 are formed on top surface 224 of body 222. As depicted in FIG. 13, each capsule port 236 has a substantially cylindrical sidewall 242 that terminates at a rounded floor 244. A small diameter eject port 246 extends from bottom surface 266 of capsule ring 220 to floor 244. Prior to use of capsule ring 220, a first capsule portion 240 is positioned within each capsule port 240. Each capsule portion 240 comprises one half of a conventional capsule used for holding drugs for oral ingestion. The capsules are typically made of a water soluble material and can be opaque or translucent. In one embodiment first capsule portion 240 comprises a tubular body 250 having an open first end and a rounded closed second end. Body 250 bounds an open compartment 252.

It is appreciated that capsule ring 220 can come in a variety of different configurations. For example, capsule ring 220 can be made larger or smaller with more or fewer capsule ports 240. Furthermore, the layout of capsule ports 240 can be varied based on the positioning of holes 40 in guide plate 18.

Returning to FIG. 9, in one embodiment capsule ring 220 has four times as many capsule ports 236 as retention plate 16 has holes 40. In alternative embodiments, capsule ring 220 can have the same number of capsule ports 236 as retention plate 16 has holes 40 or can have any factor thereof. As discussed below, capsule ports 236 are positioned so as to be selectively aligned with holes 40 on retention plate 16. Body 222 has a substantially circular inside edge 228 that bounds a central opening 230. A pair of opposing prongs 232 and 234 project from inside edge 228 into opening 230. A guide hole 238 is formed on top surface 224 of each prong 232 and 234.

With continued reference to FIG. 9, during operation base assembly 14 is coupled with capsule ring 220. This is accomplished by inserting pins 60A and 60D (FIG. 3) projecting from guide plate 18 into guide holes 238 on capsule ring 220. In this position, base assembly 14 rests on top surface 224 of capsule ring 220 and is prevented by pins 60A and 60C from rotating relative to capsule ring 220. Holes 40 are formed on guide plate 18 (FIG. 2) so as to be aligned with corresponding capsule ports 236 when guide plate 18 is coupled with capsule ring 220. Either prior to or following coupling of base assembly 14 with capsule ring 220, stop plate 22 is moved to the first position between retention plate 16 and guide plate 18 so as to block communication between holes 80 on retention plate 16 and holes 40 on guide plate 18.

Figure 10:
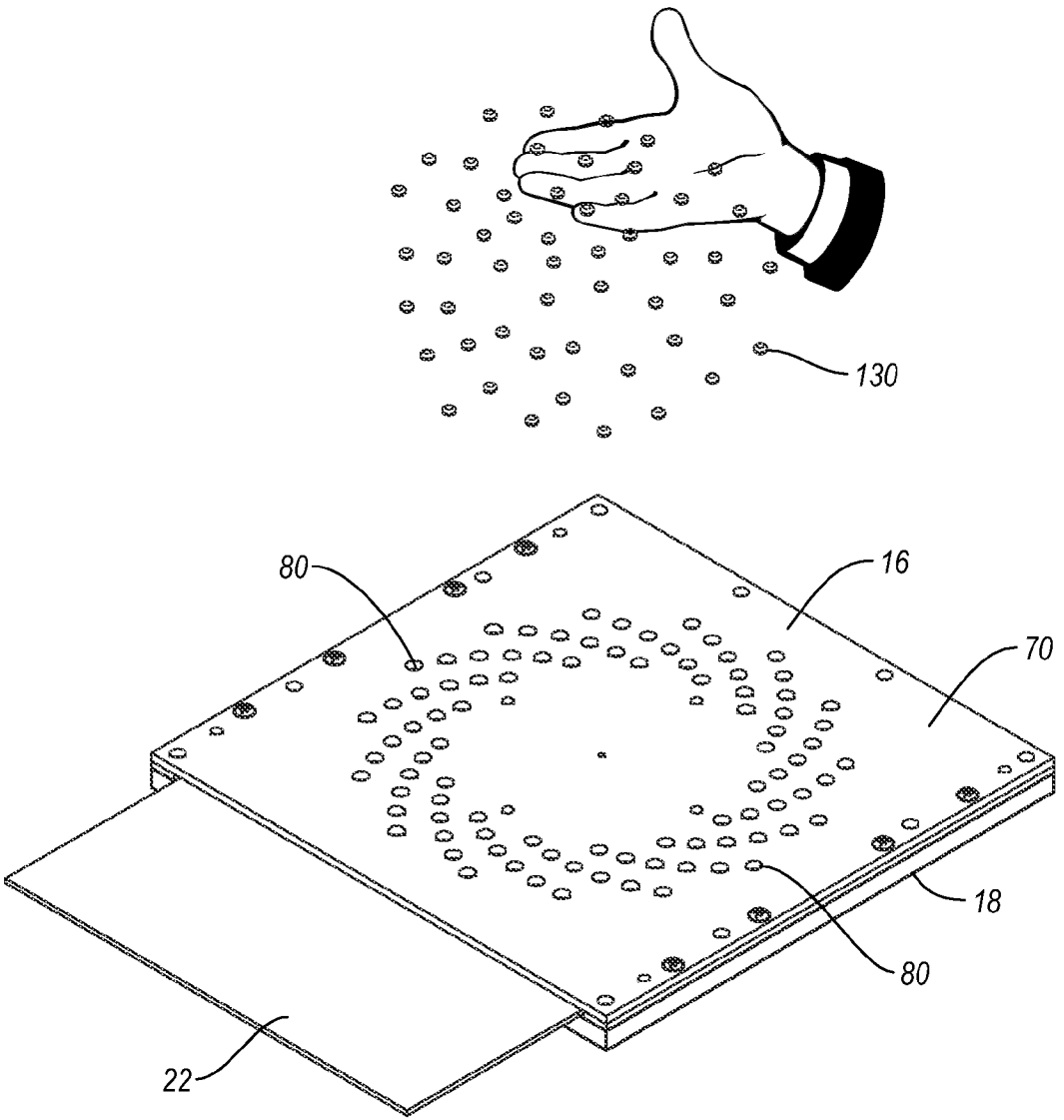
FIG. 10 is a perspective view of the assembly shown in FIG. 9 having tablets positioned thereon.

Turning to FIG. 10, tablets 130 are dispensed onto top surface 70 of retention plate 16. Tablets 130 are then manipulated so that a tablet 130 is positioned within each of holes 80. Positioning of tablets 130 into holes 80 can be either automated or manual. If desired, an upstanding border (not shown) can be positioned around retention plate 16 so as to prevent tablets 130 from unintentionally falling off of top surface 70.

As depicted in FIG. 13, holes 80 are typically designed so as to be just slightly larger than the outer perimeter of tablets 130 but typically have the same general configuration as the perimeter of tablets 130. This configuration enables tablets 130 to easily fall into holes 80 so that the bottom surface 134 of tablets 130 rests on top surface 94 of stop plate 22. This configuration also helps ensure that tablets 130 are centered within holes 80 so that splitters 120 properly align with tablets 130 when splitters 120 are received within holes 80.

Figure 11:
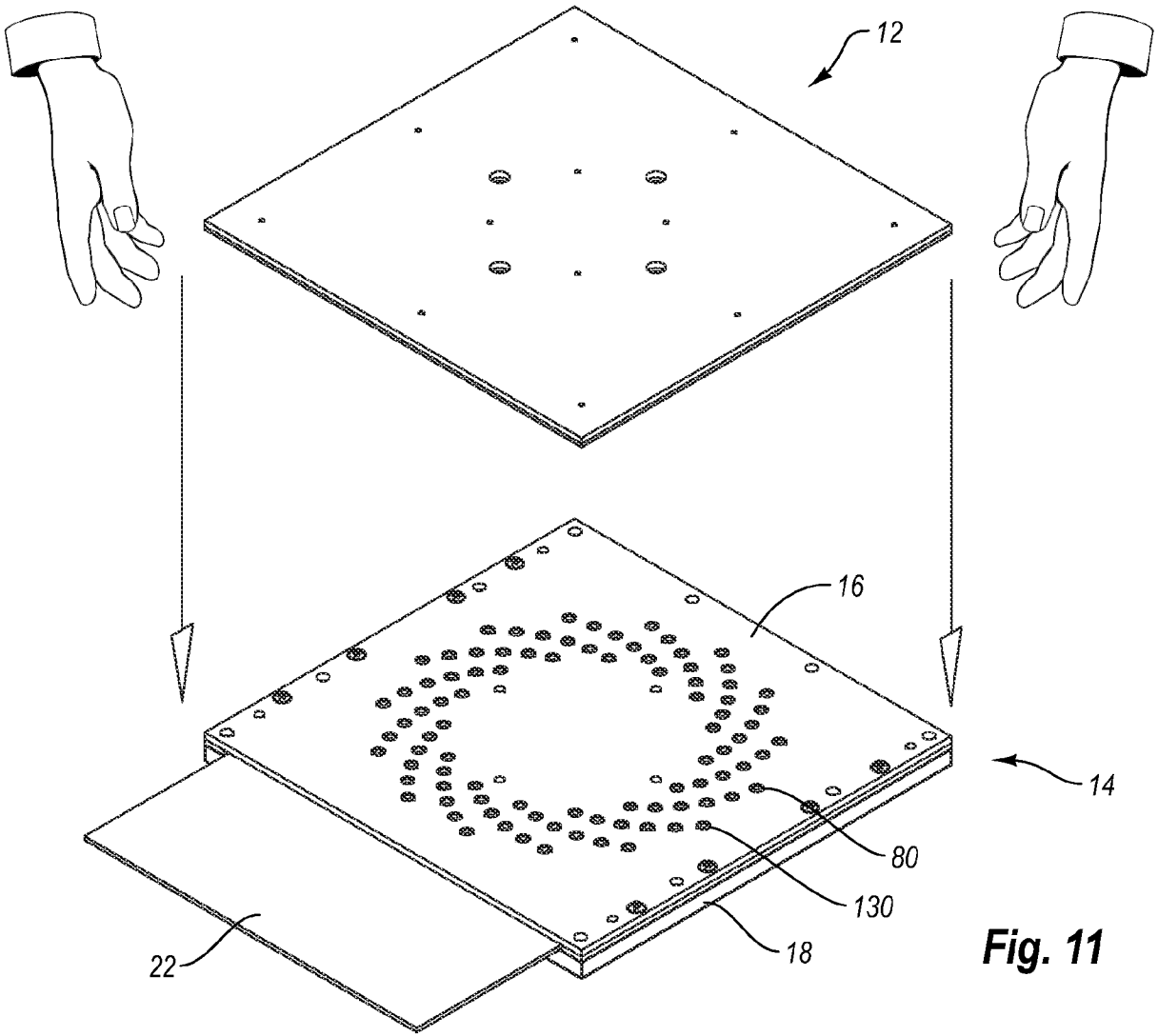
FIG. 11 is a perspective view of the splitter assembly shown in FIG. 1 being mounted on the base assembly shown in FIG. 1.

Turning to FIG. 11, once tablets 130 are positioned within holes 80, splitter assembly 12 is advanced onto retention plate 16 so that each splitter 120 is received within a corresponding hole 80. With reference again to FIG. 14, in one embodiment holes 80 have a depth extending between top surface 70 and bottom surface 72 of retention plate 16 that is larger than the thickness T of tablets 130. This ensures that an open space 254 having a length L is formed between the top surface of each tablet 130 and top surface 70 of retention plate 16. Open space 254 functions as a guide to ensure that all of splitters 120 are properly received within a corresponding hole 80 prior to splitters 120 having to bias against tablets 130. In one embodiment the length L of open space 254 is in a range between about 0.2 cm to about 1.5 cm with about 0.2 cm to about 0.5 cm being more common. Other lengths can also be used.

Figure 12:
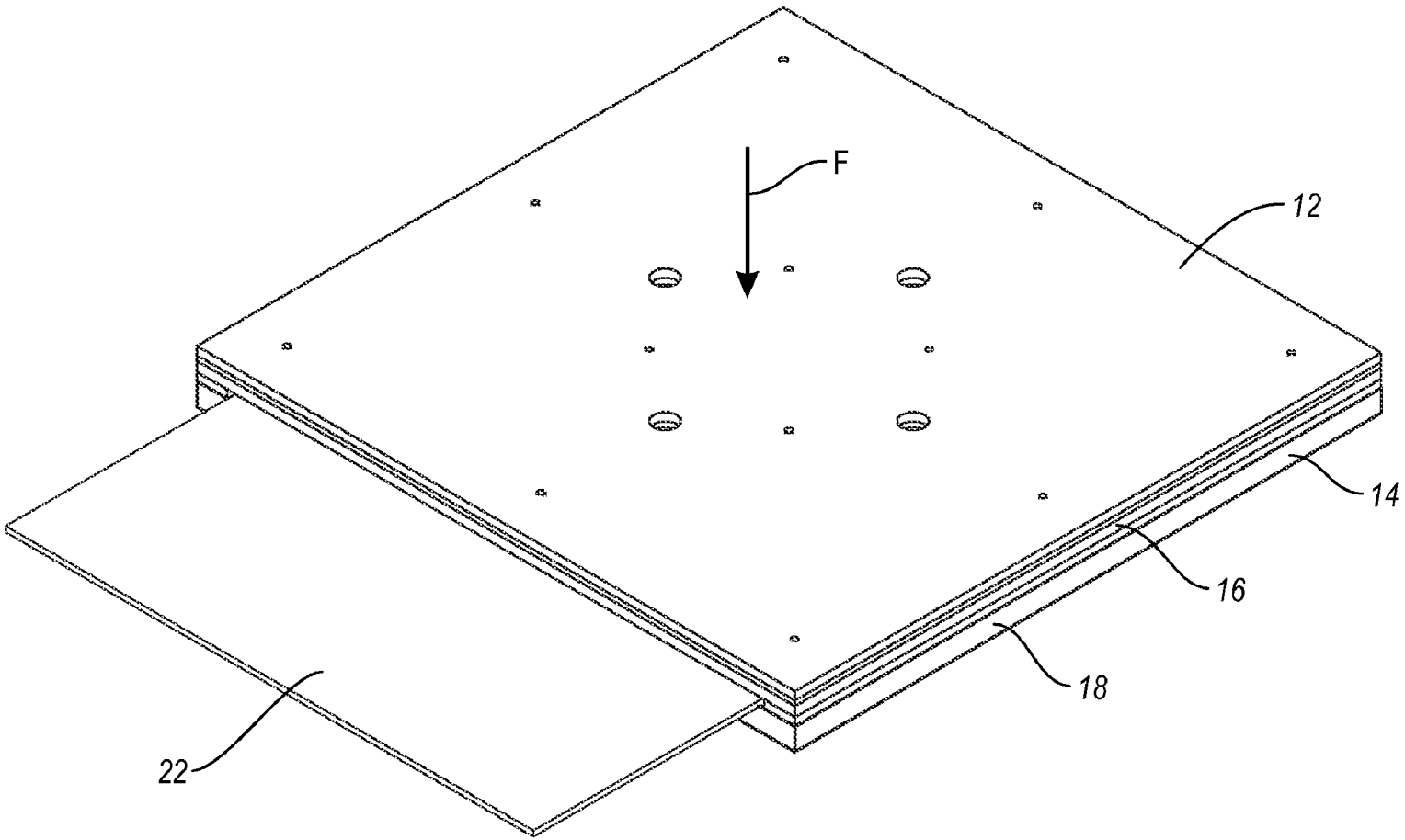
FIG. 12 is a perspective view of the splitter assembly being pressed down upon the base assembly.

Once splitter assembly 12 is advanced onto retention plate 16, as depicted in FIG. 12, a downward force F, either manual or mechanical, is applied on splitter assembly 12. In turn, as depicted in FIG. 13, each tablet 130 is compressed between a corresponding splitter 120A and top surface 94 of stop plate 22 so as to split each tablet 130 into two equal halves as previously discussed. In the embodiment depicted, splitter assembly 14 is configured so that bottom surface 118 of splitter plate 114 biases against top surface 70 of retention plate 16 when splitters 120A have been advanced sufficiently far into holes 80 to properly split tablets 130. In this regard, the engagement between splitter plate 114 and retention plate 16 functions as a stop so as to prevent splitters 120A from crushing tablets 130 within holes 80. In alternative embodiments, splitter plate 114 need not contact retention plate 16. Rather, mechanical devices can be used to repeatedly advance splitters 120A to a predefined location relative to stop plate 22. In yet other embodiments, pressure sensors can used to determine when a desired load as been applied by splitters 120A onto tablets 130. It is appreciated that splitter plate 114 can be eliminated and each splitter 120A can be coupled to and operated by an independent actuator. In this regard, it is not necessary that tablets 130 be split simultaneously.

In one embodiment, splitter assembly 12, retention plate 16, guide plate 18 and stop plate 22 can be made of a transparent polymeric material such as PLEXIGLASS which is comprised of polymethyl methacrylate or HYZOD which is comprised of a polycarbonate. As a result, an operator can, if desired, inspect each tablet 130 without removing splitter assembly 12 so as to ensure that all of tablets 130 have been properly split. If one or more tablets 130 have not split, additional force can be applied to splitter assembly 12 over the identified tablets 130 to ensure splitting. If one or more tablets 130 have split into three or more parts where only two parts are desired, a pick or other tool can be used to remove the tablet parts within the corresponding hole 80. Once all of tablets 130 are appropriately split, splitter assembly 12 can be removed as depicted in FIG. 14. In alternative embodiments, it is appreciated that splitter assembly 12, retention plate 16, guide plate 18 and stop plate 22 need not be made from a transparent material but can be made from opaque materials such as metals, ceramics, polymers, composites and the like. In yet other embodiments, select elements can be transparent while others are opaque.

Figure 15:
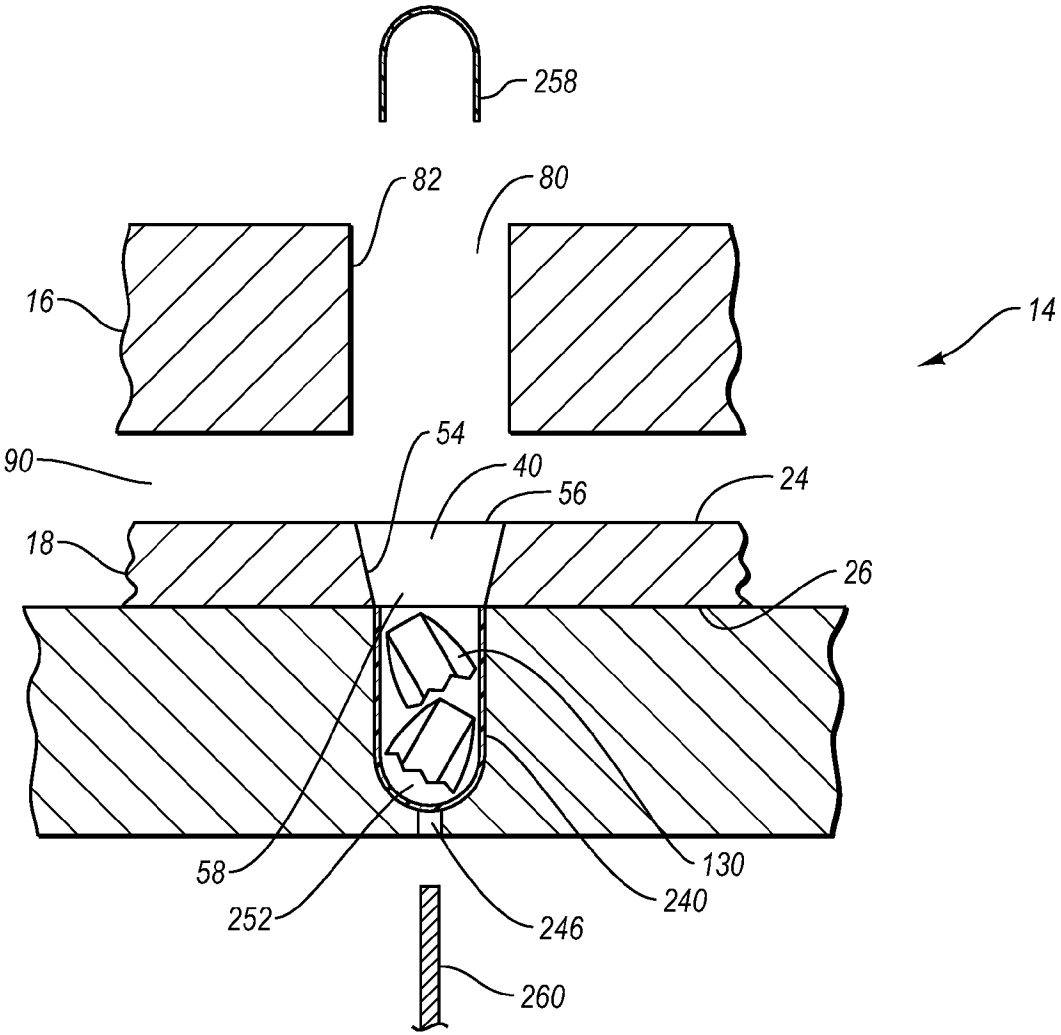
FIG. 15 is a cross section side view of the assembly shown in FIG. 14 wherein the stop plate has been removed and the split tablet positioned within a first capsule portion.

Next, as depicted in FIG. 15, stop plate 22 is slid out from between retention plate 16 and guide plate 18 to the second position. In so doing, broken halves of tablets 130 freely fall down through holes 40 in guide plate 18 and into compartments 252 of first capsule portions 240. Interior surface 54 of each hole 40 is tapered, as previously discussed, so that constricted opening 58 of guide plate 18 is substantially the same size as the opening to first capsule portion 240. Interior surface 54 thus guides broken halves of tablets 130 into first capsule portions 240. Once stop plate 22 is removed, the operator manually inspects each first capsule portions 240 to determine that the tablet portions have been fully received within first capsule portion 240 and are not wedged within hole 40. A pick or other device can be used to manipulate any wedged tablet portions so they are all received within their respective first capsule portion 240.

Once the tablet portion are appropriately positioned, base assembly 14 is separated from capsule ring 220, rotated 90°, and then coupled again with base assembly 14 by inserting pins 60B and 60D (FIG. 3) into guide holes 238 (FIG. 9). In this position, holes 40 in guide plate 18 are aligned with new capsule ports 236 in capsule ring 220 containing empty first capsule portions 240. The process as previously discussed above with regard to FIGS. 12-15 is then repeated. By subsequently rotating base assembly 14 relative to capsule ring 220 two additional times, all of the first capsule portions 240 loaded on capsule ring 220 can be filled with split tablets 130. It is appreciated that the number of times that base assembly 14 is rotated relative to capsule ring 220 is dependent on a number of factors including the number of holes 40 in guide plate 18 and the number of capsule ports 236 in capsule ring 220. By varying the number of holes 40 and/or the number of capsule ports 236, the number of relative rotations can also be varied.

With continued reference to FIG. 15, once all of first capsule portions 240 have received a split tablet 130, base assembly 14 is separated from capsule ring 220. If desired, a fill powder can then be used to fill the voids within first capsule portions 240 around split tablets 130. A second capsule portion 258 can then be mounted on the open end of each first capsule portion 240 so as to form a final capsule that encloses a single split tablet 130 therein. An ejector pin 260 can be passed through eject port 246 to raise first capsule portions 240 so that second capsule portions 258 can be mounted thereon and for use in removing the finished capsules from capsule ring 220.

In view of the foregoing, the present invention provides methods and apparatus for rapidly or substantially simultaneously splitting a plurality of tablets into two or more substantially equal parts. If desired, the present invention also provides methods and apparatus for easily and efficiently dispensing each split tablet into a corresponding capsule which can then be used in drug trials or other conventional uses. In other embodiments, it is appreciated that the split tablets need not be dispensed into a capsule or that only a portion of each split tablet may be dispensed into a capsule.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for splitting tablets, the method comprising:

placing each of a plurality of tablets within a separate one of a plurality of holes, each hole extending between a top surface and a corresponding bottom surface of a retention plate, each tablet having a maximum thickness measured along a first axis extending through each tablet between a top surface and an opposing bottom surface of each tablet and having maximum width measured along a second axis extending though each tablet at an orientation perpendicular to the first axis, the maximum width being greater than the maximum thickness, the bottom surface of each of the plurality of tablets being supported on a stop plate positioned below the retention plate so that first axis along which the maximum thickness of each tablet is measured extends along the length of each corresponding hole of the retention plate;

substantially simultaneously splitting each of the plurality of tablets into at least two parts while the plurality of tablets are disposed within the holes extending through the retention plate and are supported on the stop plate; and moving at least a portion of the stop plate relative to the retention plate so that the at least two parts of each separate tablet fall from the stop plate into a compartment of a separate one of a plurality of first capsule portions, each first capsule portion being designed for oral consumption and being comprised of a material that decomposes when consumed orally, whereby each first capsule portion contains the at least two parts of only a single one of the plurality of tablets.

2. The method as recited in claim 1, wherein the step of substantially simultaneously splitting each of the plurality of tablets comprises:

passing each of a plurality of splitters into a separate one of the plurality of holes extending through the retention plate, the plurality of splitters being introduced into the holes through the top surface of the retention plate; and compressing each of the plurality of tablets between a corresponding one of the plurality of splitters and the stop plate so as to split each of the tablets into the at least two parts.

3. The method as recited in claim 1, wherein the step of moving at least a portion of the support structure comprises moving the stop plate relative to the retention plate so that the at least two parts of each tablet fall into the compartment of the separate one of the plurality of first capsule portions.

4. The method as recited in claim 3, further comprising providing a guide plate between the retention plate and the plurality of first capsule portions, the guide plate having a plurality of holes extending between a top surface and a corresponding bottom surface of the guide plate, the at least two parts of each tablet passing through a corresponding one of the plurality of holes in the guide plate as the at least two parts of each tablet fall into the compartment of the separate one of the plurality of first capsule portions.

5. The method as recited in claim 1, further comprising seating the plurality of first capsule portions onto a capsule ring prior to the step of moving the at least a portion of the support structure.

6. The method as recited in claim 5, further comprising rotating the retention plate relative to the capsule ring following the step of moving and then repeating the steps of placing, substantially simultaneously splitting, and moving for a plurality of new tablets.

7. The method as recited in claim 1, further comprising removing one or more select tablets that have split into three or more parts from the corresponding hole of the retention plate prior to the step of moving.

8. The method as recited in claim 1, further comprising coupling a corresponding one of a plurality of second capsule portions with a corresponding one of the plurality of first capsule portions so as to form a plurality of capsules, each capsule having the at least two parts of a corresponding one of the plurality of tablets enclosed therein.

9. The method as recited in claim 1, wherein the step of substantially simultaneously splitting each of the plurality of tablets comprises compressing each of the plurality of tablets against the stop plate on which the tablets are supported so as to split each of the plurality of tablets into the at least two parts.

10. The method as recited in claim 1, wherein the step of substantially simultaneously splitting each of the plurality of tablets comprises compressing each of the plurality of tablets against a top surface of the stop plate on which the tablets are supported so as to split each of the plurality of tablets into the at least two parts.

11. The method as recited in claim 2, wherein each splitter comprises a stem that terminates at a distal end face.

12. The method as recited in claim 1, wherein the length of each hole extends between the top surface and the bottom surface of the retention plate.

* * * * *

UNITED STATES PATENT AND TRADEMARK OFFICE

CERTIFICATE OF CORRECTION

PATENT NO. : 7,971,765 B2
APPLICATION NO. : 11/681598
DATED : July 5, 2011
INVENTOR(S) : David A. Engle It is certified that error appears in the above-identified patent and that said Letters Patent is hereby corrected as shown below:

Drawings

Sheet 6, replace Figure 8B with the figure depicted below, wherein the reference number "120" has been changed to --210--

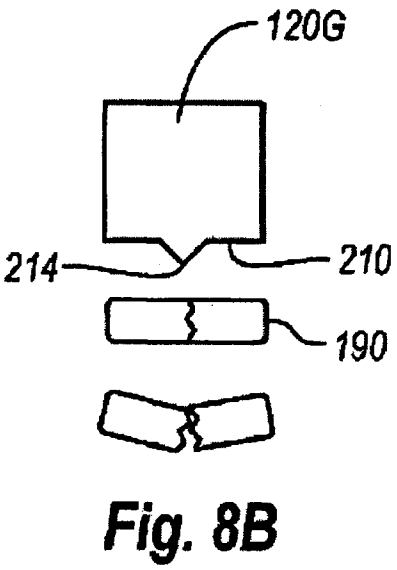

Fig. 8B

Column 2

Line 65, change "planer or complimentary" to --planar or complementary--

Column 3

Line 59, change "patter" to --pattern--

Column 4

Line 7, change "planer" to --planar--
Line 9, change "planer" to --planar--
Line 10, change "complimentary" to --complementary--

Column 5

Line 9, change "planer" to --planar--
Line 11, change "planer" to --planar--
Line 12, change "complimentary" to --complementary--
Line 30, change "slide" to --slid--

Signed and Sealed this
Twenty-second Day of November, 2011

David J. Kappos

David J. Kappos
*Director of the United States Patent and Trademark Office*

Column 7
Line 3, change “planner” to --planar--
Line 6, change “planner” to --planar--
Line 17, change “arm 172 and 174” to --arm 170 and 172--
Line 18, change “planer” to --planar--
Line 39, change “planer” to --planar--
Line 44, change “planer” to --planar--
Line 46, change “planer” to --planar--

Column 8
Line 1, after “configurations” insert --that--
Line 20, change “capsule port 240” to --capsule port 236--

Column 9
Line 41, after “can” insert --be--
Line 42, change “as” to --has--

Column 10
Line 17, change “portion” to --portions--